US005871274A

United States Patent [19]

Lee et al.

[11] Patent Number: 5,871,274

[45] Date of Patent: Feb. 16, 1999

[54] STRETCHABLE AND CONTRACTABLE DESK LAMP DEVICE

[76] Inventors: An Hsun Lee, No.63-1, Zong Ming S Rd., Chunli City, Taoyuan Hsien, Taiwan; Fred Mendelsohn, 1214 W. Cass St., Tampa, Fla. 33606

[21] Appl. No.: 891,681

[22] Filed: Jul. 11, 1997

[51] Int. Cl.[6] ..... F21S 3/12; F21V 17/02

[52] U.S. Cl. ..... 362/413; 362/220; 362/278; 362/280; 362/285; 362/352; 362/399; 362/414; 362/427; 362/450

[58] Field of Search ..... 362/220, 278, 362/280, 285, 320, 352, 410, 413, 414, 399, 418, 427, 450

[56] References Cited

U.S. PATENT DOCUMENTS

| | | | |
|---|---|---|---|
| 2,740,039 | 3/1956 | Phillips | 362/413 |
| 2,897,349 | 7/1959 | Cirot | 362/414 |
| 3,369,117 | 2/1968 | Nicolosi | 362/413 |
| 4,323,955 | 4/1982 | Mark | 362/278 |
| 4,744,019 | 5/1988 | Krogsrud | 362/427 |
| 4,972,306 | 11/1990 | Bornhorst | 362/278 |
| 5,012,394 | 4/1991 | Woodward | 362/413 |
| 5,169,226 | 12/1992 | Friedman | 362/413 |

*Primary Examiner*—Alan Cariaso
*Attorney, Agent, or Firm*—Pro-Techtor International Services

[57] ABSTRACT

The device of a stretchable and contractable desk lamp comprising a lamp shade and a stand, the lamp shade is pivotally connected on one end thereof to a first pivot connection on the top of the stand, the connection is for pivotal mounting of a handle for carrying the lamp, the bottom of the stand is provided with a second pivot connection for pivotally mounting of a separated rotating seat, the lamp thus has a function of rotating with two pivot axles, and is portable and can save space in packaging; a receptacle is provided on the top of and engaged with the lamp shade, the receptacle receives a stretchable or drawable frame therein, a magnifying glass is provided in the frame and can be stretched out and firmly kept in a suitable anglular position on the lamp shade for viewing under illumination, the magnifying glass can be hidden in the receptacle when not in use.

4 Claims, 10 Drawing Sheets

STRETCHABLE AND CONTRACTABLE DESK LAMP DEVICE

BACKGROUND OF THE INVENTION

1. Field of the Invention

The present invention is related to the device of a stretchable and contractable desk lamp, and especially to a device wherein two pivot colnnections are provided, the first pivot connection on the lamp stand for pivotally connecting the lamp shade is used for pivotally mounting a handle, this can simplify the assembling elements and space for the handle; and the second pivot connection on the bottom of the stand is provided with a round hole for pivotal mounting of a separated rotating seat. The whole lamp can thereby afford the function of wide range illumination by adjustment in taking advantage of the two pivot connections, while the separated rotating seat is comprised of a main seat and an auxiliary seat, this can save space of packaging by virtue that they can be disassembled; within the allowable space tolerance favourable for packaging, a receptacle is provided on and engaged with the lamp shade, the receptacle is provided therein with a pair of slide ways for hiding a frame therein, in the frame there is a magnifying glass mounted to be drawable or stretchable, the magnifying glass can be positioned on one side of the lamp shade in a suitable angle for viewing, so that a user can see clearly things under illumination of the desk lamp; therefore, the structure of the desk lamp of the present invention further includes the handle, the separated rotating seat using the second pivot connection and the magnifying glass.

2. Description of the Prior Art

Desk lamps in the markets are referred to the lamps wherein each lamp is comprised of an upright stand which is mounted with a lamp shade holding a lamp bulb or a lamp tube, this forms the basic construction of the desk lamp and is suitable for use on a common desk, an office desk or a working desk etc. for illumination. However, the lamps can be various in their shapes, the lamp shades and stands thereof in the markets are made with numerous shapes and fashions; in which, one is shown in FIGS. 1 and 2, the conventional desk lamp shown is provided with two pivot knobs 21 by which a lamp shade 1 can be pivotally connected to the top of a stand 2, the lamp shade 1 can be adjusted or moved to make stretching or contracting function. When this conventional desk lamp having the functions of stretching and contracting is stretched out (as shown in FIG. 1), the lamp tube thereon can be turned on for emitting light to illuminate in a desired angle position; on the contrary, when the lamp shade 1 is contracted to close over one side of the stand 2 (as shown in FIG. 2), volume of the lamp is reduced for storing or packaging.

However, the conventional desk lamp still has the following undesired defects, and is necessary to be improved in the present invention:

1. The light source thereof can only be adjusted about one axis, when in use, it can not afford illumination for a broad area of the desk unless the stand is wholly moved.

2. There is no handle provided with, when it is carrying to another place for use, the user must grasp the stand or the lamp shade thereof not suitable for grasping, a risk of dropping of the lamp is thereby increased.

3. When the user needs to read fine words or articles, a magnifying glass must be obtained, this induces inconvenience.

The undesired defects of the conventional desk lamp also are found frequently on the desk lamps of other fashoins, this is becaused that, if a desk lamp is provided with rotating axles in two directions, it is very difficult to make a design with the function of rotating with two pivot axles and for including both a handle and a magnifying glass.

Although some desk lamps in the markets are mounted each with a rotating seat, a handle or a magnifying glass, they are of the exposed and fixed types, they make unecessary visual impedence and also are unfavourable to saving of packaging space, and thus need improvement.

SUMMARY OF THE INVENTION

In view that desk lamps in the markets have no simple and effective functional design for their peripheral facilities, and it is required to increase auxiliary functions within the allowable space tolerance favourable for packaging the desk lamp, a motive thus is created in the mind of the inventor to study and develop the present invention.

The object of the present invention is that: within the allowable space tolerance favourable for packaging a desk lamp, the accessories of a handle, a rotating seat and a magnifying glass are additionally provided on the desk lamp; thereby under the condition not overly increasing the package volume thereof, functions of improving the desk lamp to be able of rotatable adjusting in two axles, convenience of carrying as well as providing of a magnifying glass for reading fine articles can be provided.

By achieving the above stated object, the present invention is characterized by:

As to providing of the handle, the handle is designed to be pivotally connected, and the rotating axle of a conventional connection additionally provided is specifically simplified here, further, by providing of the rotating axle of the first pivot connection on the lamp stand for pivotally connecting the lamp shade, the handle can be directly pivotally provided on the lamp, and when the handle is spreaded out, it can be used for carrying the whole lamp device, while when the handle is collapsed, space occupied can be reduced.

As to providing of the separated rotating seat pivotable about a second pivot connection, the rotating seat is made in the form of a round disk to increase the bottom area of the lamp device for obtaining stability, and the separated rotating seat is comprised of a main seat and an auxiliary seat in order to save space of packaging by virtue that they can be disassembled, and they can be mounted on the bottom of the stand, thus rotating about the second pivot connection and stability of the lamp can be additionally effected.

As to providing of the magnifying glass which is stretchable and conatractable, after the lamp shade is collapsed and closed over the front side of the stand, the space left above the bottom seat of the stand when in packaging permits the lamp shade to be additionally engaged with a receptacle in which a stretchable or drawable frame is provided, and the magnifying glass is mounted in the frame, so that when the lamp shade is stretched upwardly for illumination, the hidden magnifying glass can be further stretched out to a suitable viewing angle, and is positioned on the side of light emitting port of the lamp shade, a user needs the magnifying glass for viewing can thus feel useful.

The present invention will be apparent in its practical structure, characteristics and functions after reading the detailed description of the preferred embodiments thereof in reference to the accompanying drawings.

DETAILED DESCRIPTION OF THE PREFERRED EMBODIMENT

Figure 1:
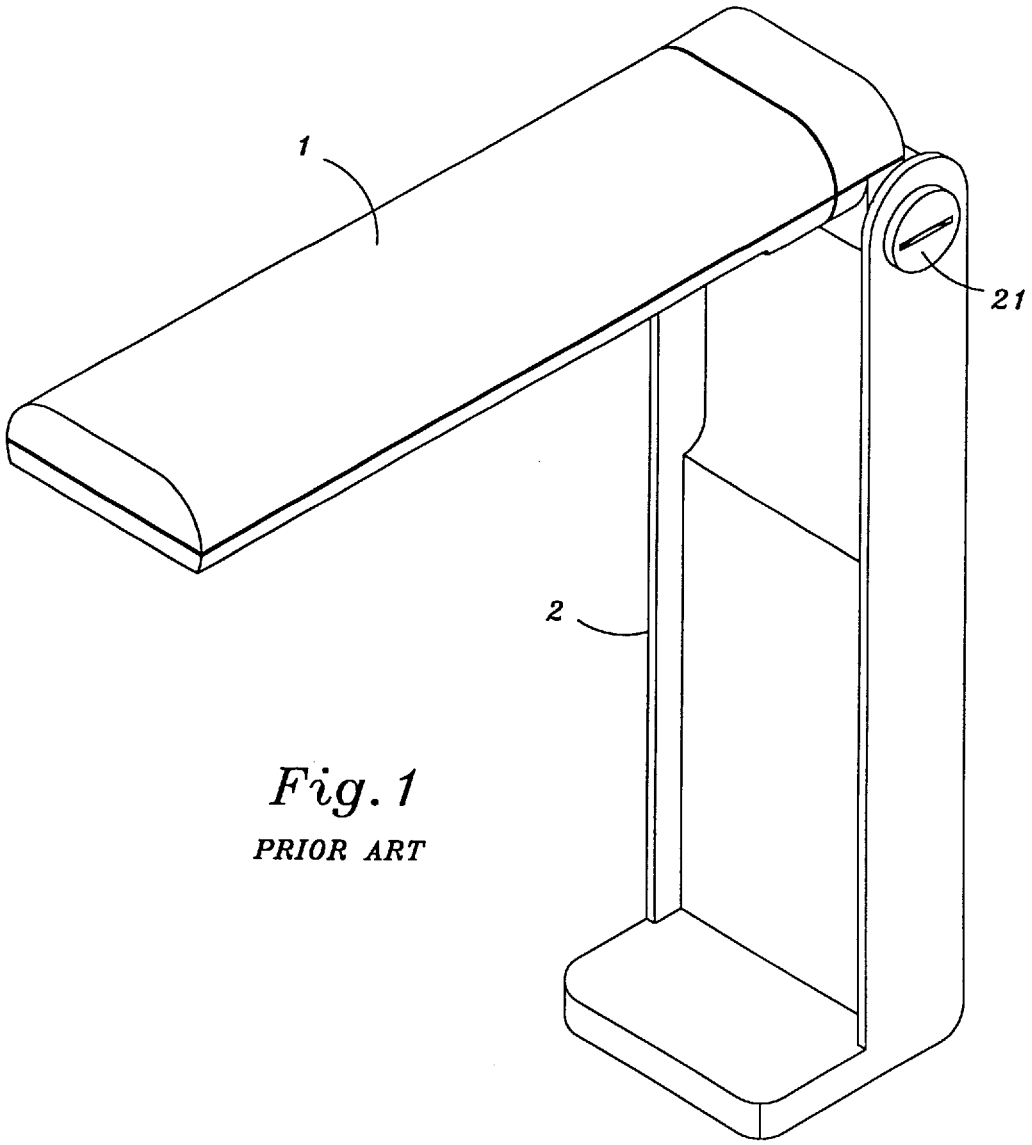
Fig. 1 PRIOR ART
FIG. 1 is a perspective view of a conventional desk lamp in its stretching state.
Figure 2:
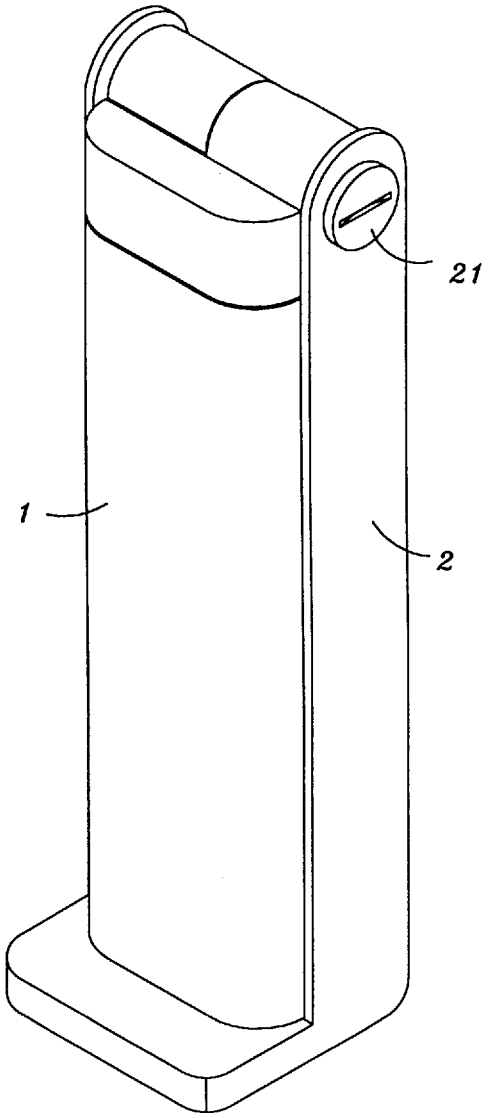
Fig.2 PRIOR ART
FIG. 2 is a perspective view of a conventional desk lamp in its contracting state.

Referring to FIG. 1 and 2 showing stretching and contracting state of a conventional desk lamp, and the present invention is provided aiming at improvement of this conventional desk lamp.

Figure 3:
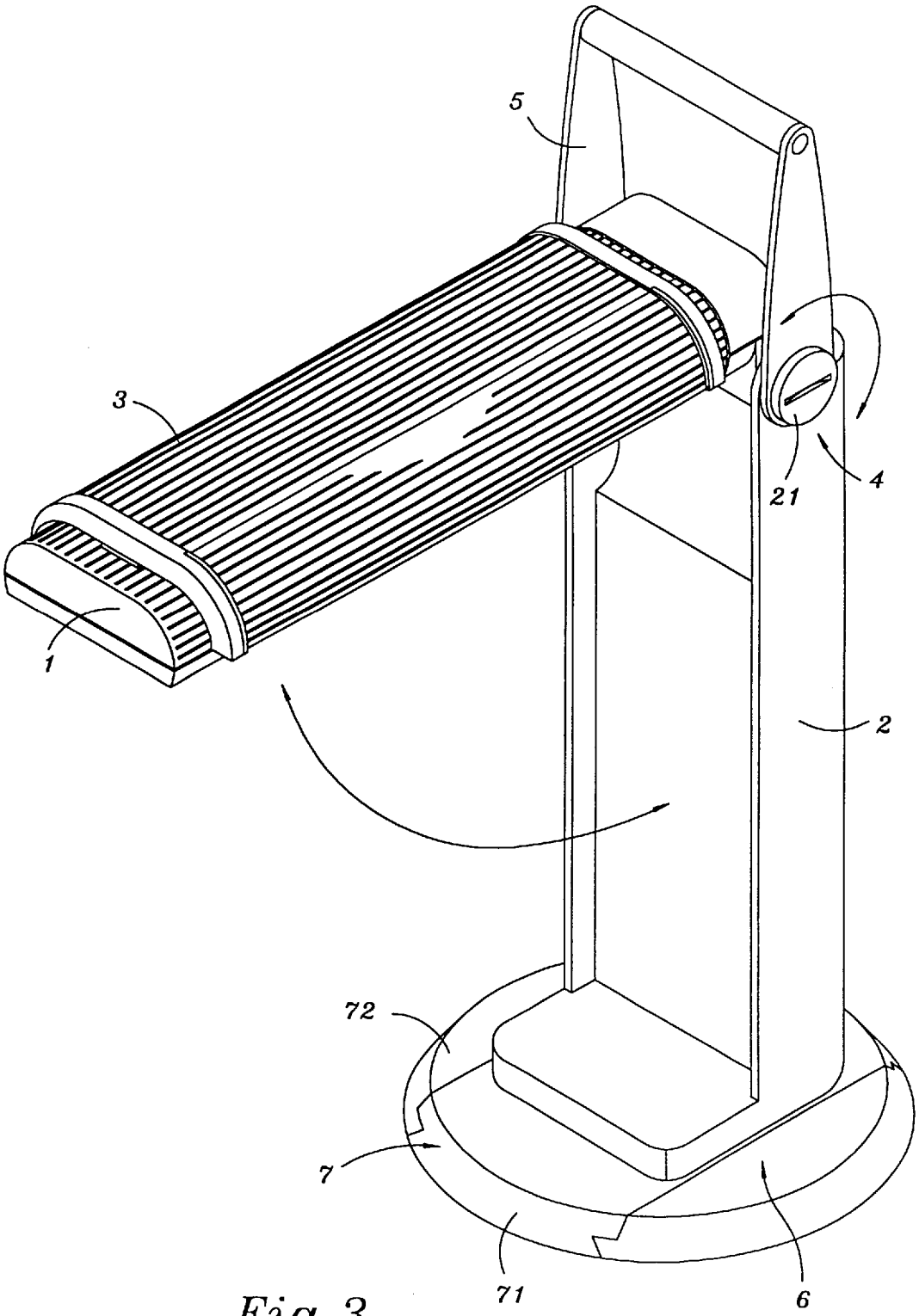
FIG. 3 is a perspective view of a desk lamp of the present invention in its stretching state.

Referring to FIG. 3, the desk lamp of the present invention is comprised of a lamp shade 1 and a stand 2, the lamp shade 1 is additionally engaged with a receptacle 3, the lamp shade 1 is pivotally connected on one end thereof to a first pivot connection 4 on the top of the stand 2, the first pivot connection 4 is connected on both sides thereof with a reverse U shaped handle 5, a second pivot connection 6 is provided at the bottom of the stand 2 to allow a separated rotating seat 7 to be pivotally mounted thereon, and in this way, the desk lamp of the present invention is completed.

Figure 4:
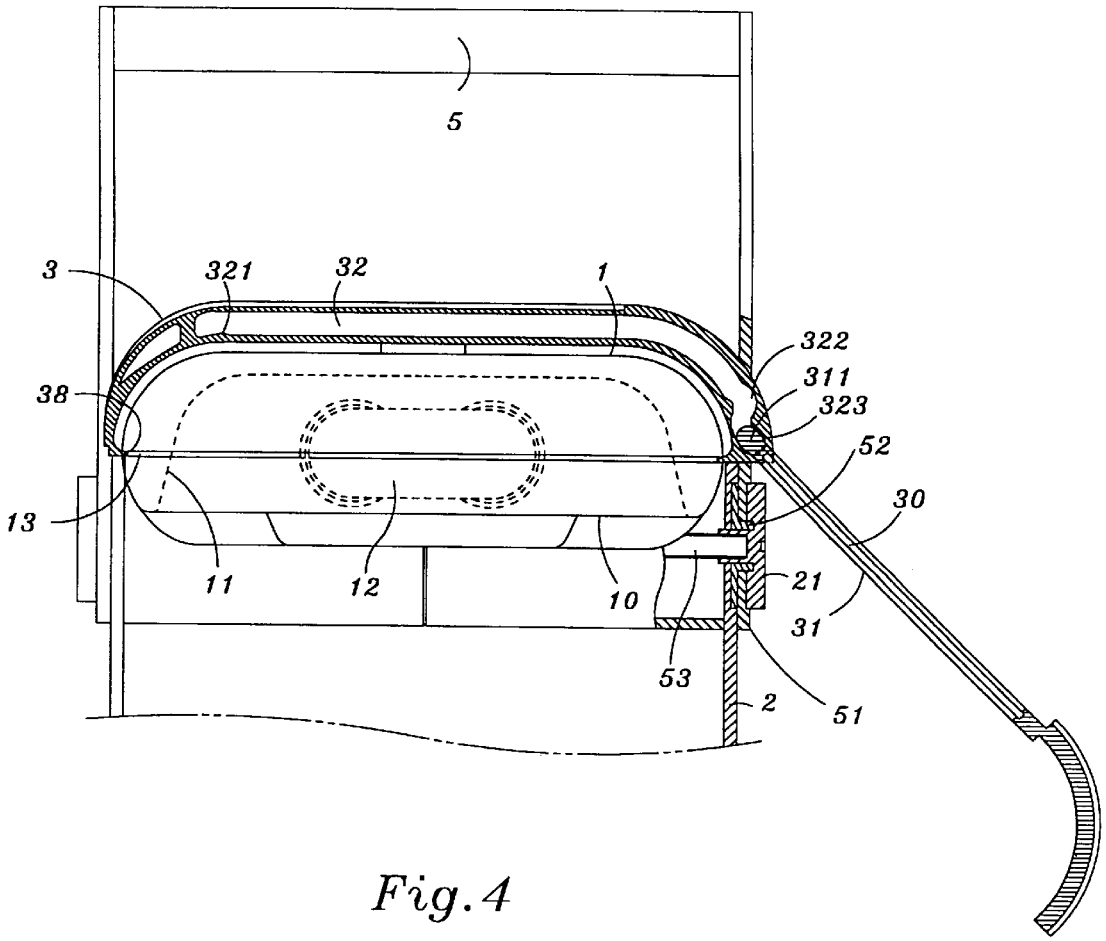
FIG. 4 is a sectional view of a desk lamp of the present invention when its magnifying glass and its handle is stretched out.

Further referring to FIG. 4, the down facing side of the lamp shade 1 is a light emitting port 10 in which a light emitting wall 11 with a lamp tube 12 therein is provided, the lamp shade 1 leaves a surrounding slit 13 on the back thereof, the above mentioned receptacle 3 having a conforming shape with the lamp shade 1 is engaged therewith in taking advantage of this surrounding slit 13.

Figure 5:
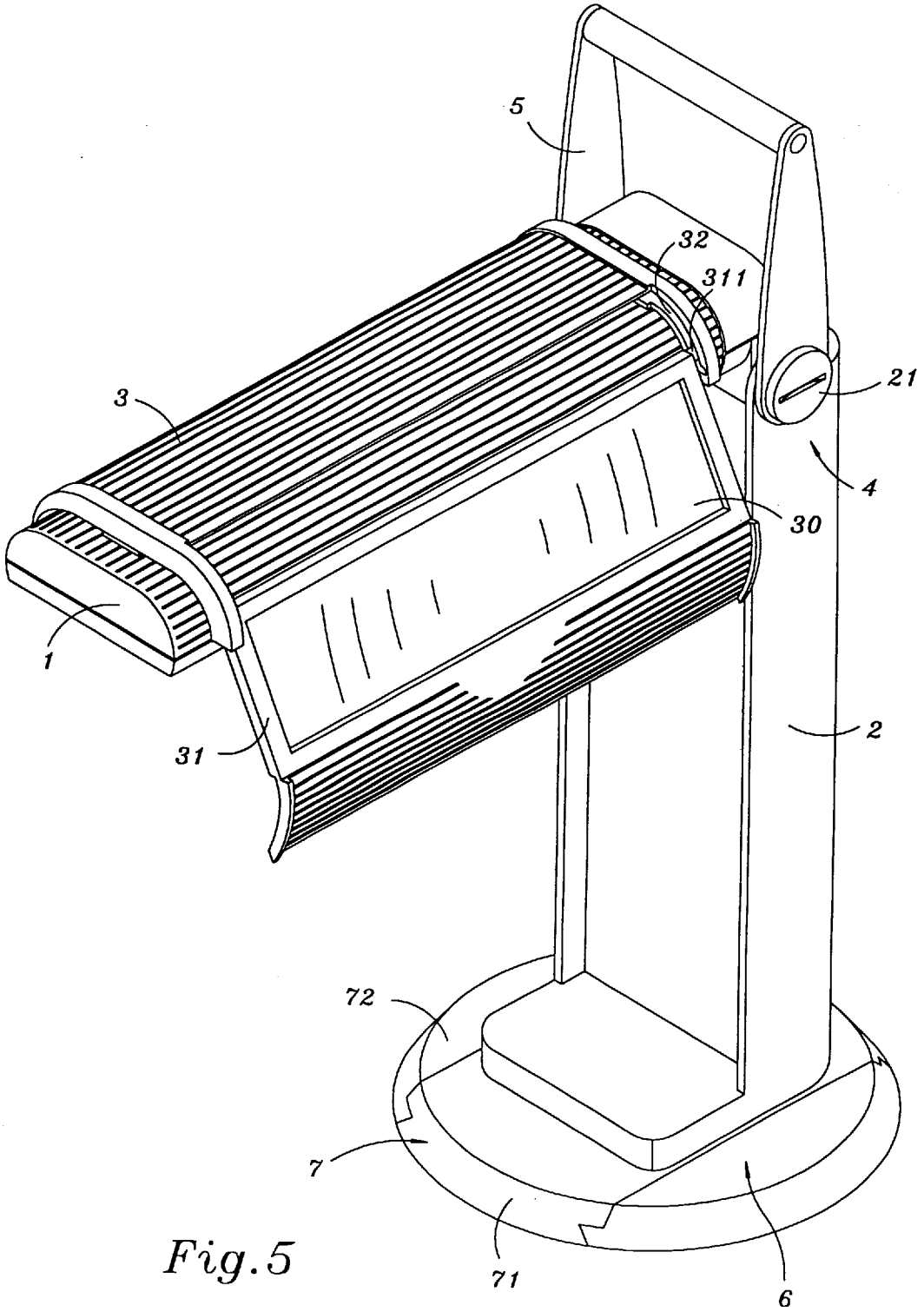
FIG. 5 is a perspective view of a desk lamp of the present invention when its magnifying glass is in a stretched state.
Figure 6:
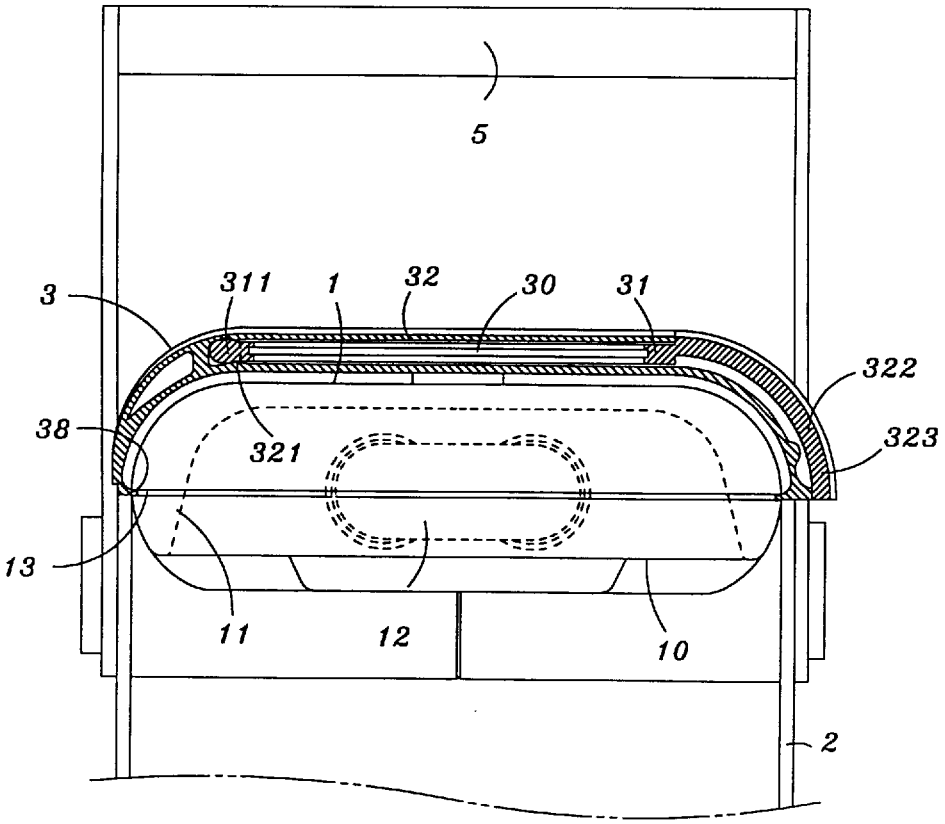
FIG. 6 is a sectional view of a desk lamp of the present invention when its magnifying glass is in a collapsed state.

Both sides of the receptacle 3 are provided with engaging portions 38 for engaging the surrounding slit 13, the whole receptacle 3 can thereby mounted on the top of the lamp shade 1; when in practical using, the receptacle 3 receives therein a drawable or stretchable frame 31, in the embodiment shown in FIG. 3 to 6, the drawable frame 31 is hidden in the receptacle 3. The receptacle 3 is further provided on both ends thereof with a pair of slide ways 32 of which the start ends each is provided with a stopping protrusion 321, the other ends thereof are provided with turning over grooves 322 and inclined positioning grooves 323, the drawable frame 31 is further provided on both ends thereof with a pair of guided lugs 311 slidable in the slide ways 32, a magnifying glass 30 is provided in the frame 31, when the drawable frame 31 is drawn out to the position as shown in FIG. 4 and 5, the guided lugs 311 can be turned over to be engaged in the inclined positioning grooves 323 when it is passed through the turning over grooves 322, so that a state that the drawable frame 31 is bevelly mounted in the receptacle 3 is made, the magnifying glass 30 is thereby firmly kept in a suitable angle for viewing; the slide ways 32 in the receptacle 3 can also be used to receive the drawable frame 31 and the receptacle 3, such as is shown in FIG. 6 and 3, wherein, the guided lugs 311 on the drawable frame 31 are moved to slide to the original positions thereof and are stopped by the stopping protrusions 321, and the whole drawable frame 31 can be hidden in position in the receptacle 3 together with the magnifying glass 30, in this way, the magnifying glass 30 of the desk lamp can be stretchable and contractable.

Figure 7:
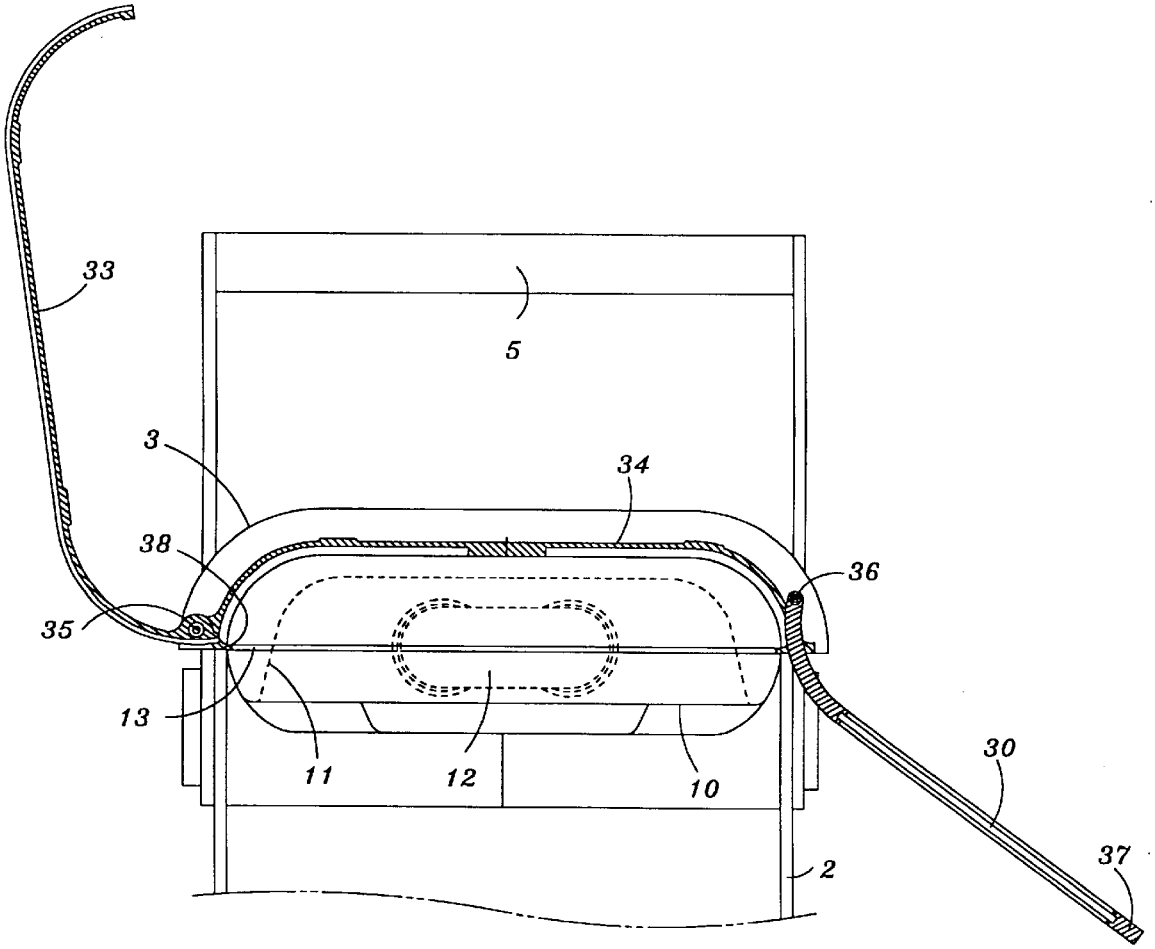
FIG. 7 is a sectional view of another embodimant of desk lamp of the present invention when its magnifying glass is stretched out.
Figure 8:
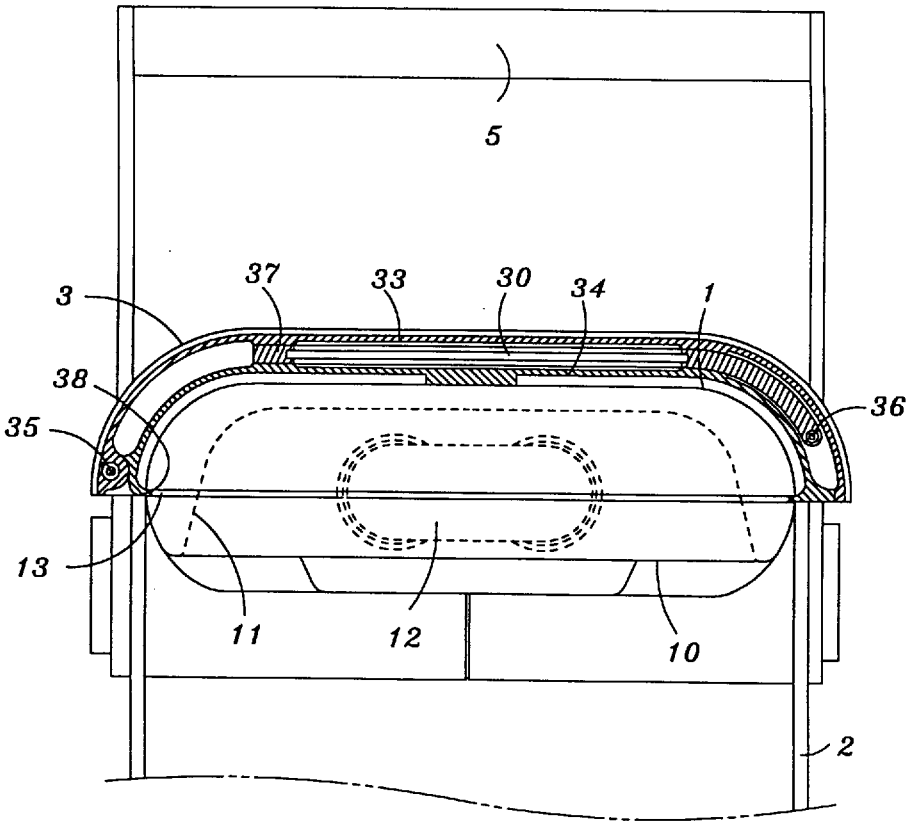
FIG. 8 is a sectional view of the embodimant of FIG. 7 when its magnifying glass is in a collap sed state.

As is stated in the forgoing paragraph, the drawable frame 31 having the magnifying glass 30 hidden in the receptacle 3 can also be arranged to form the embodiment shown in FIGS. 7 an 8, wherein, the chamber for receiving the magnifying glass 30 in the receptacle 3 is made to have an upper lid 33 and a lower seat 34 which are connected with each other at a first pivotal connection 35, the other end of the lower seat 34 is provided at a suitable position with a second pivotal connection 36 which in turn is pivotally connected to a frame 37, also there is a magnifying glass 30 in the frame 37 as required; thereby, as shown in FIG. 7, when the magnifying glass 30 in the frame 37 is to be turned clockwise to stretch out, it only needs to uncover the upper lid 33, the frame 37 can thus be turned out to one side of the lamp shade 1 and to a position having a suitable angle for viewing; and when the magnifying glass 30 is retracted as shown in FIG. 8, the magnifying glass 30 on the frame 37 can also be hidden between the upper lid 33 and the lower seat 34, so that the second embodiment for the magnifying glass 30 on the frame 37 to be stretchably stored in the receptacle 3 is provided.

As to the reverse U shaped handle 5 mounted with its two ends on the two ends of the first pivot connection 4 provided on the top of the stand 2, as is depicted in FIGS. 3 and 4, a pair of pivot holes 51 provided on both ends of the handle 5 are provided with annuli 52 which are compatible to screw mounting of the pivot knobs 21 of conventional style onto a rotating axle 53, the handle 5 thus is mounted on the first pivot connection 4 provided on the top of the stand 2, the handle 5 and the lamp shade 1 thus take the first pivot connection 4 as a fulcrum, free adjustment for rotation can thereby be obtained.

Figure 9:
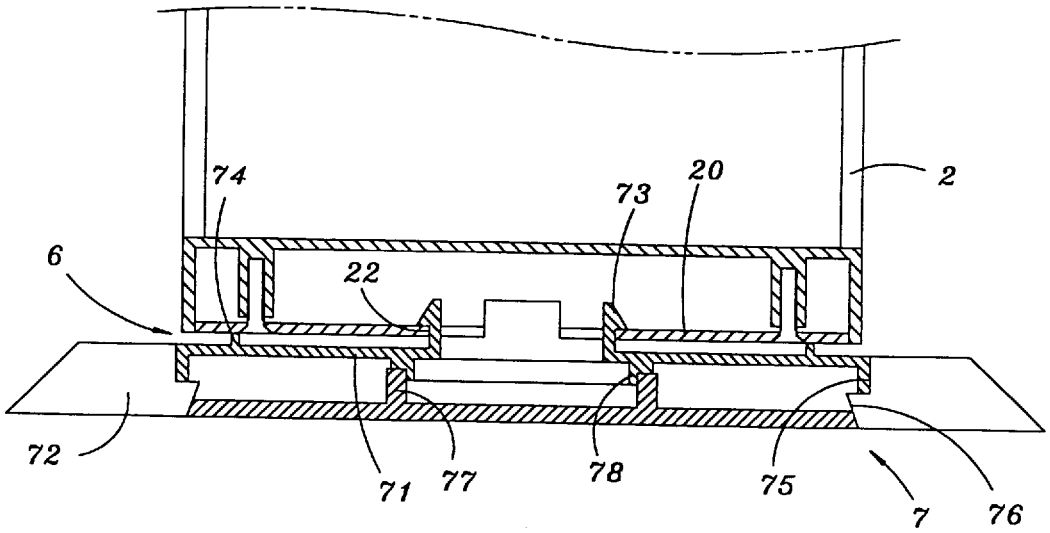
FIG. 9 is a sectional view showing assembling of the rotating seat of a desk lamp of the present invention.

Moreover, as shown in FIGS. 3 and 9, the separated rotating seat 7 of the second pivot connection 6 provided at the bottom of the stand 2 is comprised mainly of a main seat 72 and an auxiliary seat 71; wherein, the auxiliary seat 71 is provided at the center thereof with four engaging pieces 73 which are surrounded by a protruding circle 74 with a suitable diameter, thereby the engaging pieces 73 of the auxiliary seat 71 can be inserted in a central round hole 22 on the bottom plate 20 of the stand 2, and the protruding circle 74 is abutted against the bottom plate 20 of the stand 2, thus the second pivot connection 6 is formed, mean time, the two lateral sides of the auxiliary seat 71 are provided with engaging pending edges 75 which are corresponding exactly in position to a pair of engaging grooves 76 provided on both sides of the main seat 72, the center of the main seat 72 is further provided with a protruding annulus 77 engageable with a protruding circle 78 on the bottom of the auxiliary seat 71, so that the auxiliary seat 71 and the main seat 72 can be engaged with each other to form the separated rotating seat 7 being in the shape of a round disk and provided at the bottom of the stand 2, in this way, the whole desk lamp device has the function of rotating by providing the second pivot connection 6 beside the function of adjustment of the lamp shade 1 by providing the first top pivot connection 4, i.e., the desk lamp device has the function of rotation effected by two pivot axles.

Figure 10:
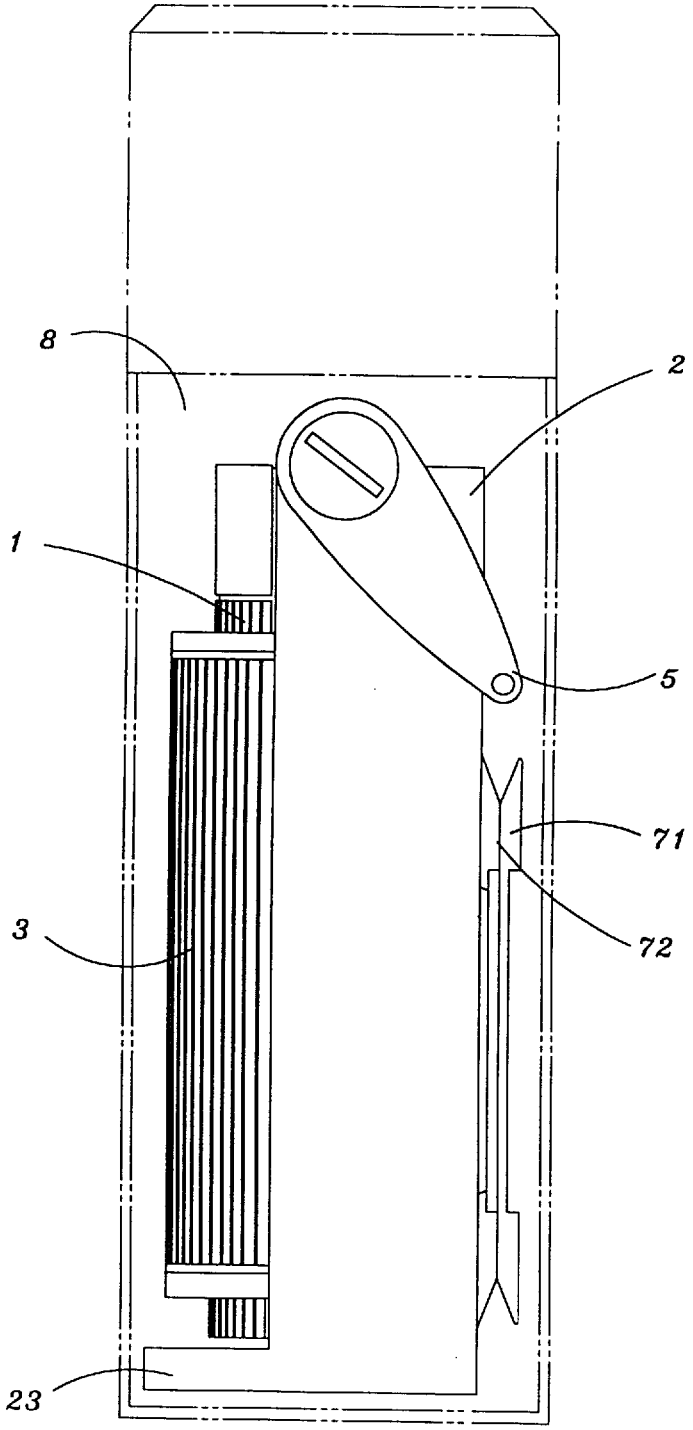
FIG. 10 is a schematic view of a desk lamp of the present invention when it is packaged and received in a box.

By the above design of the components, as shown in FIG. 10, when in packaging, within the given space tolerance of the packaging box 8 for a conventional desk lamp, the space in the packaging box 8 above that occupied by the front end of the bottom seat 23 of the stand 2 can be used to receive the collapsed receptacle 3 enveloping the lamp shade 1, while the space under the handle 5 hidden on the back of the stand 2 can be used to receive the dismantled auxiliary seat 71 and main seat 72, in this way, the packaging box 8 is not overly occupied by the desk lamp with the additional components.

Accordingly, the desk lamp of the present invention can be augmented by adding functional components, in order that the desk lamp can be adjusted for wide range illumination by two pivot connections provided therein, and that the handle can be grasped to carry the desk lamp to other places, and that the magnifying glass can be stretched out for a better viewing.

Having thus described the technical structure of my invention with practicability and outstanding improveness, therefore, what I claim as new and desire to be secured by letters patent of the united states are:

We claim:

1. The device of a stretchable and contractable desk lamp comprising a lamp shade and a stand, wherein, said lamp shade is additionally engaged with a receptacle, said lamp shade is pivotally connected on one end thereof to a first pivot connection on the top of said stand to thereby be a stretchable and contractable lamp shade having therein a lamp tube, the bottom side of said lamp shade is opened as a light emitting port, said lamp shade leaves a surrounding slit on the back thereof, a bottom of said stand is provided with a bottom seat which is extended forwardly from said stand, said device is characterized in that:

a receptacle is provided on the top of and engaged with said lamp shade, both sides of said receptacle are provided with engaging portions for engaging said surrounding slit, said receptacle receives therein a stretchable and contractable frame, a magnifying glass is provided in said frame, said magnifying glass can be stretched out from said receptacle on the top of said lamp shade and firmly kept in a suitable anglular position for viewing, said magnifying glass can be hidden in said receptacle when it is not used;

said first pivot connection is provided on the top of said lamp stand for pivotally mounting a handle;

a second pivot connection for rotating said desk lamp for wide range illumination is provided on the bottom of said stand and formed by providing on said bottom a round hole for pivotal mounting therein of an auxiliary seat by means of a plurality of engaging pieces provided on said auxiliary seat and spaced mutually in a circle, said auxiliary seat is provided with two engaging pending edges which are corresponding exactly in position to a pair of engaging grooves provided on both sides of a main seat, said auxiliary seat and said main seat can be assembled with each other by mutual engaging to thereby form a separated rotating seat of the shape of a round disk;

by assembling of the above components, when in packaging, said lamp shade is stored at one side of said stand together with said receptacle, the extension of said receptacle does not exceed the edge of said bottom seat extending forwardly from said stand, said handle is hidden on the back of said stand, and said auxiliary seat and said main seat are separated and packed in the space unused at the back of said stand, all the components are packed within the space tolerable by a given conventional box, therefore, said desk lamp is improved to be portable, to be with a function of magnifying for clear viewing, and with a function of rotating with two pivot axles for wide range illumination.

2. The device of a stretchable and contractible desk lamp as claimed in claim 1, wherein, said stretchable and contractible frame received in said receptacle provided therein with said magnifying glass is stretched and contracted by means of a pair of slide ways provided on both ends of said receptacle and two guided lugs provided on both ends of said frame, so that said guided lugs can be slidably provided in said slide ways, so that said magnifying glass of said frame is stretchable out and contractible into said receptacle.

3. The device of a stretchable and contractible desk lamp as claimed in claim 2, wherein, the start ends of said slide ways each is provided with a stopping protrusion used to engage said guided lugs when said frame is contracted, the other ends of said slide ways are provided with turning over grooves and inclined positioning grooves, by said turning over grooves, said guided lugs can rotate easily, said magnifying glass can be swivelled to a suitable angle for clear viewing by limitation of said inclined positioning grooves.

4. The device of a stretchable and contractible desk lamp as claimed in claim 1, wherein, said stretchable and contractible frame provided with said magnifying glass and received in said receptacle is stretched and contracted by means or a chamber receiving said magnifying glass in said receptacle said chamber has an upper lid and a lower seat which are conected with each other at a first pivotal connection, the other end of said lower seat is provided with a second pivotal connection which in turn is pivotally connected to said frame receiving said magnifying glass, when in use, said upper lid is uncovered, said frame receiving said magnifying glass can thus be turned out to one side of said lamp shade and to a position having a suitable angle for viewing, and when in collapsing, said frame can be hidden between said upper lid and said lower seat.

* * * * *